US005980397A

United States Patent [19]

Hart et al.

[11] Patent Number: 5,980,397

[45] Date of Patent: Nov. 9, 1999

[54] BAT TRAINING WEIGHT

[76] Inventors: David Welch Hart, 1110 Woodlawn Ave., Wilmington, Del. 19805; Brian A. Barnabie, 75 S. Brookline Dr., Laurel Springs, N.J. 08021

[21] Appl. No.: 09/061,138

[22] Filed: Apr. 16, 1998

[51] Int. Cl.[6] ..... A63B 69/00

[52] U.S. Cl. ..... 473/437; 473/422; 473/457; 482/105

[58] Field of Search ..... 473/516, 564, 473/437, 256; 482/105

[56] References Cited

U.S. PATENT DOCUMENTS

| | | | |
|---|---|---|---|
| 3,427,020 | 2/1969 | Montour et al. | 482/105 |
| 3,618,945 | 11/1971 | Kuchar | 473/457 |
| 3,623,724 | 11/1971 | Lande | 473/437 |
| 3,904,465 | 9/1975 | Hasse et al. | 156/199 |
| 4,303,239 | 12/1981 | Walsh, Jr. | 482/105 |
| 4,746,117 | 5/1988 | Noble | 473/566 |
| 4,777,743 | 10/1988 | Roehrig, Jr. | 36/132 |
| 4,838,546 | 6/1989 | Winston | 482/105 |
| 4,997,183 | 3/1991 | Winston | 482/105 |
| 5,484,156 | 1/1996 | Giguere | 473/256 |
| 5,547,445 | 8/1996 | Chang | 482/105 |

*Primary Examiner*—Jeanette Chapman
*Assistant Examiner*—M. S. Chambers

[57] ABSTRACT

A weighted device that attaches to a baseball or softball bat for the purpose of increasing the bat's mass during batting practice thereby increasing a persons strength and improving their bat control, ultimately improving their batting average and batting power. The device can be used during the actual practice of hitting a ball. The device can be attached to the bat at various locations along the tapered portion of the bat.

1 Claim, 4 Drawing Sheets

BAT TRAINING WEIGHT

BACKGROUND OF THE INVENTION

1. Field of Invention

The present invention relates a device for improving a persons strength for swinging a baseball or softball bat. Specifically, the present invention relates to attaching a temporary adjustable weight to a bat that is used during actual batting practice and increases the inertial resistance of a swing, requiring more effort of the batter, inducing an increase in muscle mass specific for swinging a bat.

2. Description of Prior Art

In the early years, athletic organizations relied on an individuals raw talent and generalized exercise that consisted of calisthenics, running and free weight training to improve their athletic teams. These efforts, if done properly, did improve the strength and endurance of these athletes for lifting weights, running and calisthenics. The next step was to transfer these improvements to the sport of interest and this generally meant to run through the fundamentals and play the game. It has also been recognized that exercise in an activity does not prepare one for another unrelated activity. Anyone whom has been active in, for example weight lifting, soon recognizes, after a day of playing touch football, the limitations of weight lifting as a preparation for touch football. Newer techniques of concurrent training are used in an attempt to add resistance and/or inertia to the athletic activity that one is attempting to improve. Examples of this is the Russian hockey team that have used steel hockey sticks and heavy pucks during their fundamentals and scrimmages, also sprinters that attach parachutes to their waists that increases resistance as they run. Similarly wrist and ankle weights are used in many sports to add inertia during practice.

SUMMARY OF THE INVENTION

The object of this invention is to provide a device that can be temporally attached to a baseball or softball bat during batting practice and has mass that induces inertial resistance when the bat is swung. This added inertial resistance causes the batter to exert more energy in the attempt to hit a ball. This increased energy in the swing of the bat builds and improves all muscle groups associated with the swing. This is of interest to most serious baseball and softball players in two ways. The increase in strength of all muscle groups associated in swinging a bat, one, improves the power of the swing thus allowing the batter to hit the ball harder and farther, and two, improves the batters control of the bat allowing the batter to place the ball with greater accuracy. The clarity of the above summary and other objectives, features and advantages of the invention will be enhanced from the Description of the Preferred Embodiment and associated drawings.

DESCRIPTION OF THE PREFERRED EMBODIMENT

Figure 1:
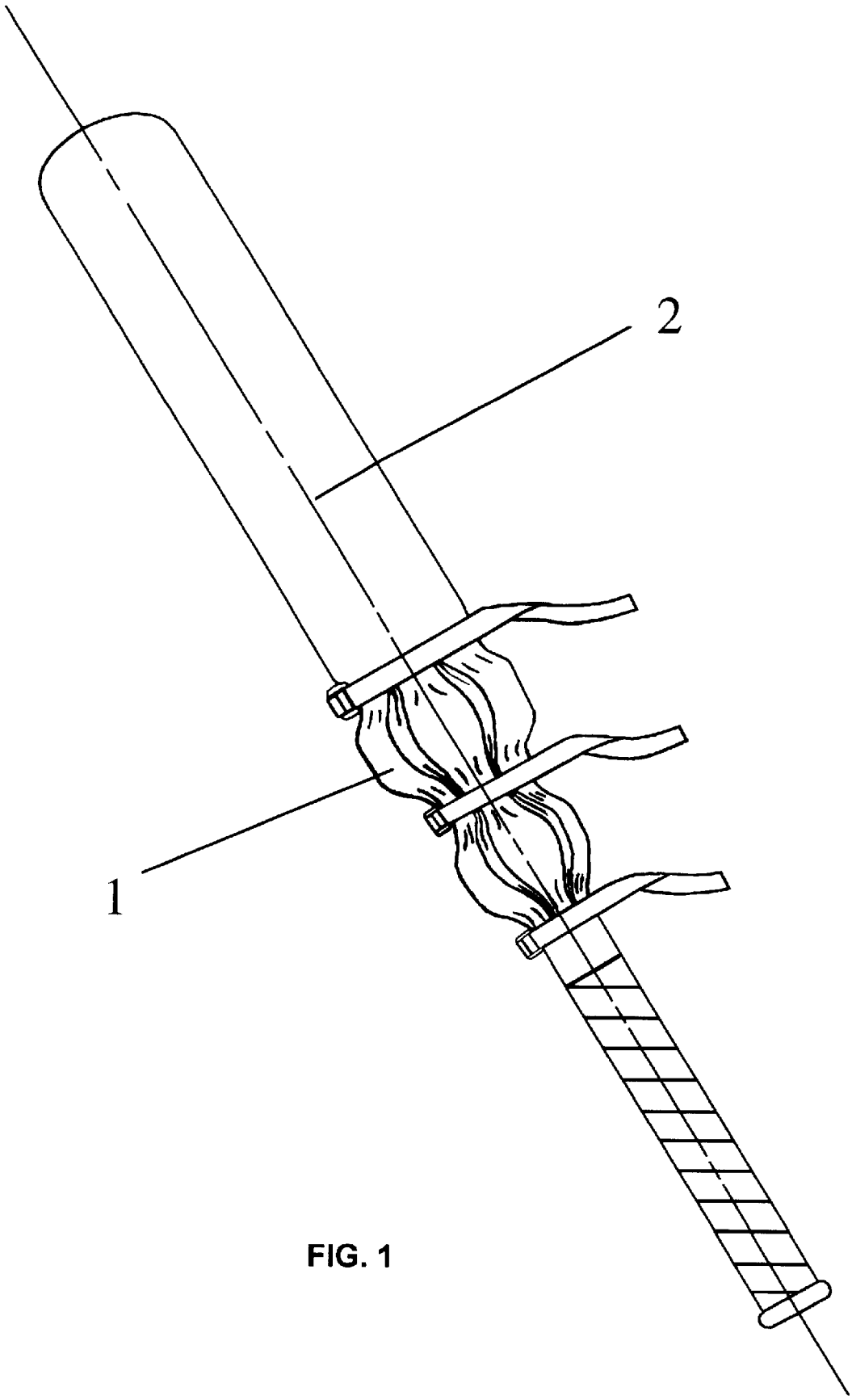
FIG. 1 is a view of the bat weight attached to a bat showing the position of the bat weight relative to a bat.

The accompanying FIGS. 1 through 4 show the preferred embodiment of the invention which is a device for adding weight to a baseball or softball bat in a manner that maintains the balance of the bat. This weight device, denoted by number 1 in FIG. 1, is wrapped and secured around the bat 2.

Figure 2:
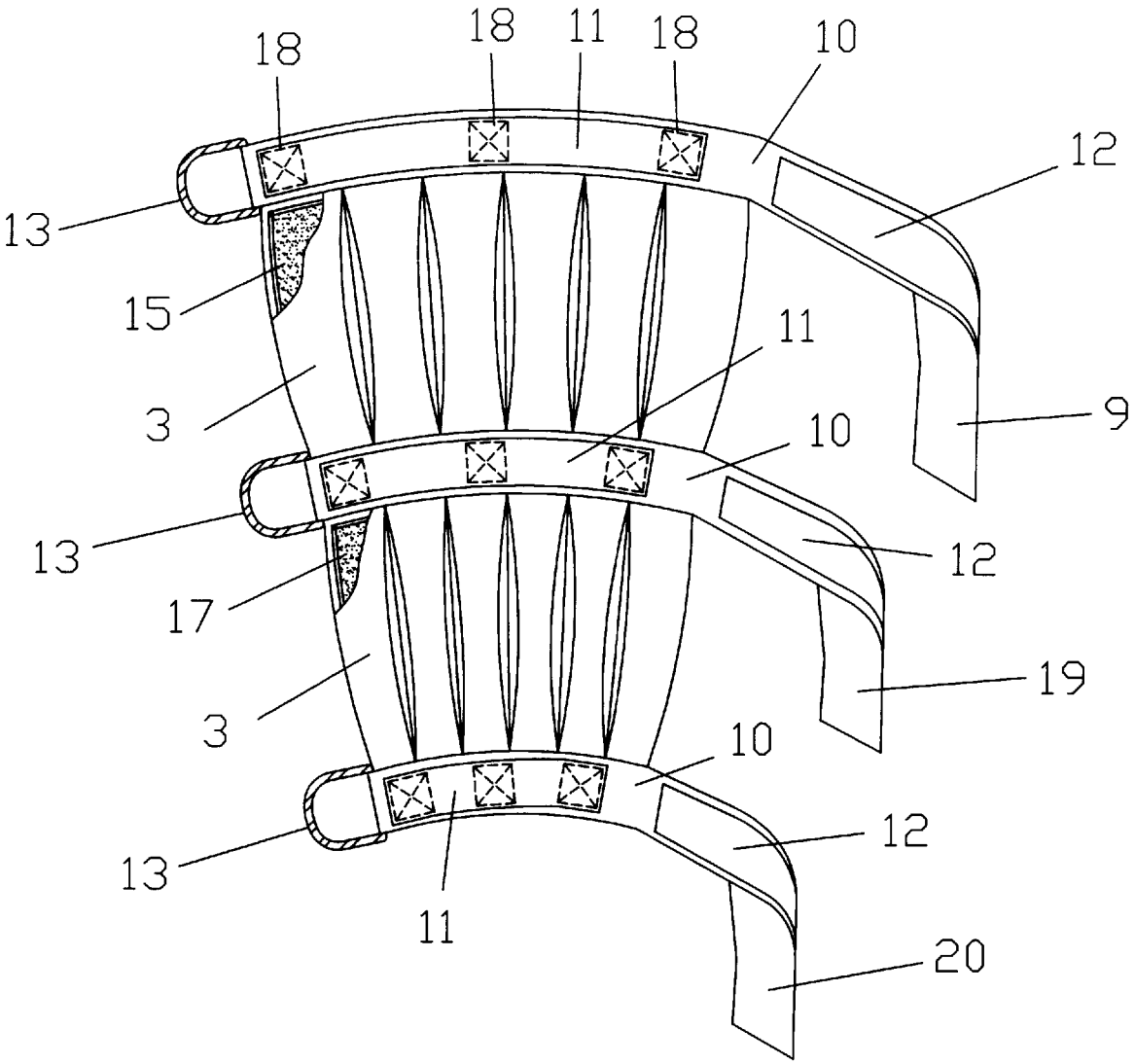
FIG. 2 is a view of the bat weight showing its outer surface and components of the basic embodiment of the bat weight.
Figure 3:
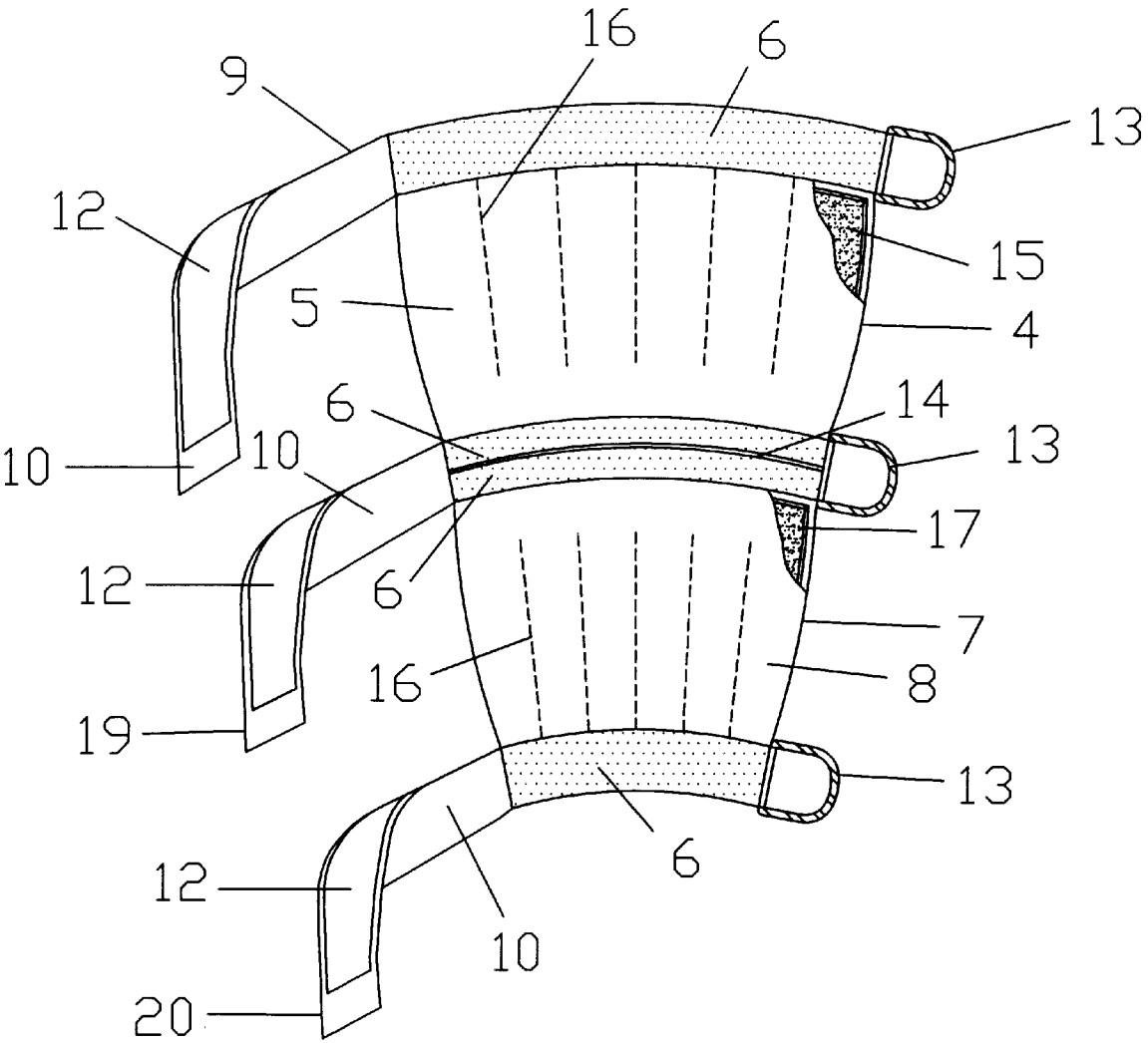
FIG. 3 is a view of the bat weight showing details of the devices inner surface.

In this embodiment, the weight device 1, shown in FIG. 2 and FIG. 3, is comprised of durable exterior fabric 3 pleated into six segments; upper interior panel 4, comprising durable upper interior fabric 5 and anti-slip fabric 6; lower interior panel 7, comprising durable lower interior fabric 8 and anti-slip fabric 6; upper securing straps 9, comprising one inch wide Nylon strip 10, adhesive backed one inch wide Velcro loop strip 11, one inch wide Velcro hook strip 12 and ⅞ inch "D" ring 13. The ⅞ inch "D" ring 13 is attached to the Nylon strip 10 by lapping one end of the Nylon strip 10 around the straight leg of the "D" ring 13 and sewing the lap back onto the Nylon strip 10 securing the "D" ring 13. The Velcro loop strip 11 is sewn onto one side of the Nylon strip 10. The length of the Velcro loop strip 11 shall approximately match the width of the pleated durable exterior fabric 3. The Velcro hook strip 12 is sewn onto the same side of the Nylon strip 10 as is the Velcro loop strip 11. The length of the Velcro hook strip 12 shall approximately match the length of the corresponding Velcro loop strip 11.

The upper interior panel 4 is sewn onto three sides of the upper portion of the durable exterior fabric 3. The bottom edge of the upper interior panel 4 is left free providing an opening 14 for access to the interior to the upper portion of the weight device 1 by which upper weight packets 15 can be inserted. Five additional seams 16 are sewn through the durable exterior fabric 3 and the upper interior panel 4 along the pleat lines. The five seams 16 start at the top of the upper interior panel 4 and extends seven eighths of the way to the bottom of the upper interior panel 4 creating six geometrically identical compartments in the upper portion of the weight device 1. Each of these compartments shall be capable of housing upper weight packet 15. The lower interior panel 7 is sewn onto three sides of the lower portion of the durable exterior fabric 3. The top edge of the lower interior panel 7 is left free providing an opening 14 for access to the interior to the lower portion of the weight device 1 by which lower weight packets 17 can be inserted. Five additional seams 16 are sewn through the durable exterior fabric 3 and the lower interior panel 7 along the pleat lines. The seams 16 start at the bottom of the lower interior panel 7 and extends seven eighths of the way to the top of the lower interior panel 7 creating six geometrically identical compartments in the lower portion of the weight device 1. Each of these compartments shall be capable of housing lower weight packet 17.

The upper securing strap 9 is sewn on to the side of the durable exterior fabric 3 through the upper inner panel 4 at three attachment locations 18. The upper securing strap 9 is attached such that the straight side of the "D" ring 13 lies adjacent to the left edge of the durable exterior fabric 3 shown in FIG. 2 and the furthest attachment location 18 from the "D" ring 13, is offset from the right edge, as shown in FIG. 2, of the durable exterior fabric 3 a distance equal to the width of the "D" ring 13. This allows the left and right side of the weight device 1 to meet once wrapped around the bat 2. Center securing strap 19 and lower securing strap 20 follow the same attachment scheme as upper securing strap 9. The center securing strap 19 is sewn only to the durable exterior fabric 3. This allows the upper weight packets 15 and the lower weight packets 17 to be inserted into the weight device 1 via the opening 14. The lower securing strap 20 is sewn on to the side of the durable exterior fabric 3 through the lower inner panel 7 at three attachment locations 18.

Figure 4:
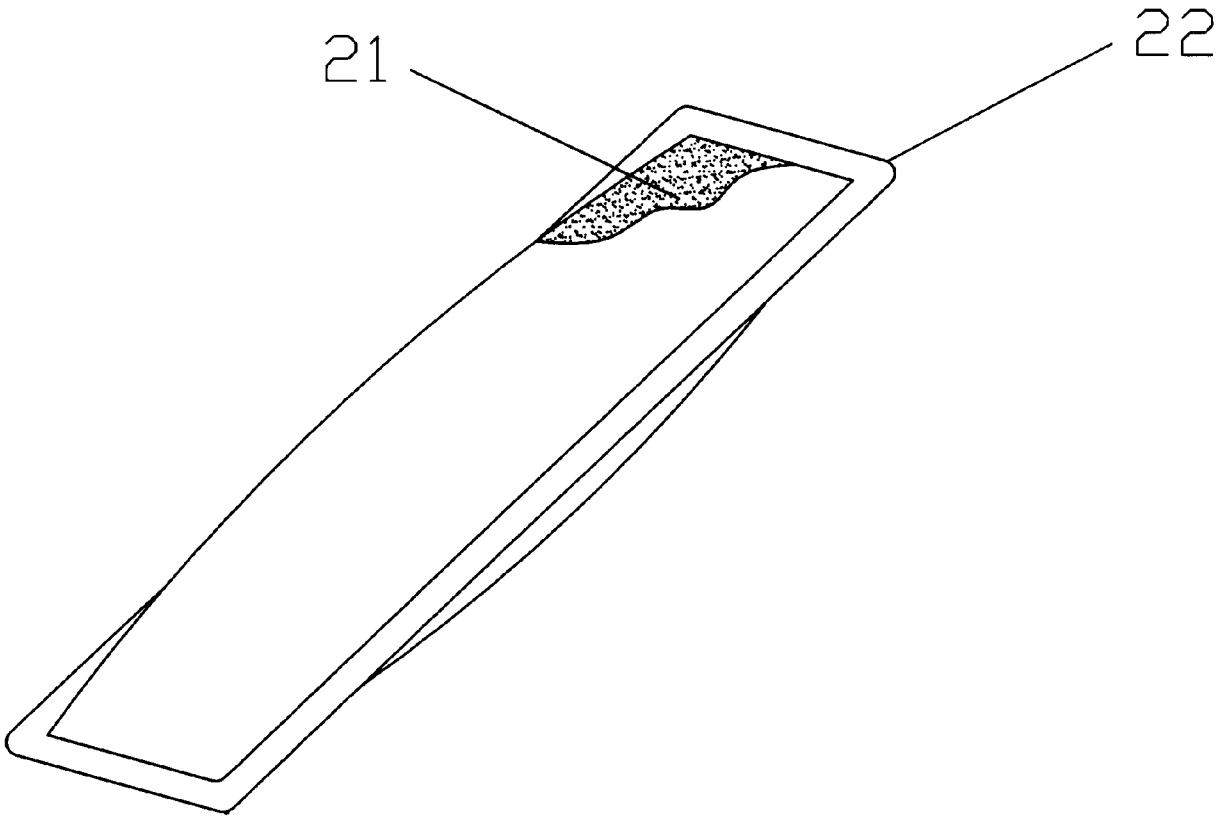
FIG. 4 is an isometric view of weight packets specific to the bat weight.

FIG. 4 depicts the weight packet comprising particulate material 21 contained in plastic film 22.

We claim:

1. A training device used in combination with a ball bat comprising:

A holding means, a weight means, a bat attachment means and a containment means for temporarily attaching said training device to said ball bat; said training device being aligned along the longitudinal axis of said ball bat;

Said containment means consisting of:

a flexible web having a web front spaced from a web rear wall; a web first end spaced from a web second end and a web first side spaced from a web second side and a plurality of weight pockets formed between said web front and said web rear; said weight pockets to have a top flap to permit insertion and removal of said weight means;

Said weight means comprising a plurality of weight packets; said weight packets to consist of a weight web front wall; a weight web rear wall, a weight web first side and a weight web second side and an amount of dense granular material enclosed by said weight web front, rear, first side and second side;

Said bat attachment means consisting of:

A plurality of ring members fixedly mounted along the longitudinal end of the web front; for each of said ring members; a flexible strap adapted to be looped through said ring member and having a strap first end mounted to the web front and said strap second end, with a strap hook and loop fastener surface extending between the strap first end and the strap second end so that when looped through said ring member, said strap may be fastened to itself.

* * * * *